United States Patent [19]

Stachurski et al.

[11] 4,354,915

[45] Oct. 19, 1982

[54] LOW OVERVOLTAGE HYDROGEN CATHODES

[75] Inventors: John Z. O. Stachurski, Amherst; Dirk Pouli, Williamsville; John A. Ripa, Lancaster; Gerald F. Pokrzyk, Lewiston, all of N.Y.

[73] Assignee: Hooker Chemicals & Plastics Corp., Niagara Falls, N.Y.

[21] Appl. No.: 104,235

[22] Filed: Dec. 17, 1979

[51] Int. Cl.[3] ..... C25B 9/00; C25B 11/06; C25B 11/10

[52] U.S. Cl. ..... 204/242; 204/290 R; 204/290 F; 204/292; 204/293

[58] Field of Search ..... 204/292, 293, 290 R, 204/290 F, 242

[56] References Cited

U.S. PATENT DOCUMENTS

| | | | |
|---|---|---|---|
| 3,291,714 | 12/1966 | Hall et al. | 204/293 X |
| 3,350,294 | 10/1967 | Hall et al. | 204/290 R |
| 3,428,544 | 2/1969 | Bianchi et al. | 204/290 F |
| 3,455,798 | 7/1969 | Mehne et al. | 204/293 X |
| 4,033,837 | 7/1977 | Kuo et al. | 204/290 R X |
| 4,080,278 | 3/1978 | Ravier et al. | 204/293 X |
| 4,105,531 | 8/1978 | Kuo et al. | 204/290 R |
| 4,152,240 | 5/1979 | Kuo | 204/293 X |
| 4,221,643 | 9/1980 | Miles et al. | 204/290 R X |
| 4,248,679 | 2/1981 | Welch et al. | 204/293 X |
| 4,251,478 | 2/1981 | Welch et al. | 204/293 X |
| 4,255,247 | 3/1981 | Oda et al. | 204/290 R X |

FOREIGN PATENT DOCUMENTS

| | | | |
|---|---|---|---|
| 4169 | 9/1979 | European Pat. Off. . | |
| 2807054 | 8/1978 | Fed. Rep. of Germany | 204/292 |
| 1132833 | 11/1968 | United Kingdom | 204/292 |
| 2015032 | 9/1979 | United Kingdom | 204/290 R |

OTHER PUBLICATIONS

Hovey et al., Journal of the Electrochemical Society 110 (5), 362–266, (1963).

Korovin et al., Soviet Electrochemistry 14, 1366–1369, (1978).

*Primary Examiner*—Donald R. Valentine

*Attorney, Agent, or Firm*—William G. Gosz

[57] ABSTRACT

A cathode for use in electrolytic processes and a process for preparing such cathodes is described. The cathode has a cathodically active surface comprising a codeposit of a first metal selected from the group consisting of iron, cobalt, nickel, and mixtures thereof, a leachable second metal or metal oxide preferably selected from the group consisting of molybdenum, manganese, titanium, tungsten, vanadium, indium, chromium, zinc, their oxides, and combinations thereof, and a third metal selected from the group consisting of cadmium, mercury, lead, silver, thallium, bismuth, copper and mixtures thereof. Such cathodes are prepared by initially forming a codeposit of the three metals or metal oxides, and subsequently removing at least a portion of the second metal or metal oxide from the codeposit. The second metal or metal oxide component can be conveniently removed by leaching, utilizing an alkaline solution. A substantially reduced hydrogen cathode overvoltage is obtained when the present cathodes are utilized in an electrolytic cell.

17 Claims, No Drawings

LOW OVERVOLTAGE HYDROGEN CATHODES

BACKGROUND OF THE INVENTION

The present invention relates to improved cathodes for use in electrolytic cells. The cathodes of this invention have improved surface coatings on their active sides which substantially lowers the hydrogen overvoltage and results in a more efficient operation of the electrolytic cell. The cathodes of the present invention are particularly useful in the electrolysis of aqueous solutions of alkali metal halides to produce alkali metal hydroxides and halogens, or in the electrolysis of aqueous solutions of alkali metal halides to produce alkali metal halates, or in water electrolysis to produce hydrogen.

In an electrochemical cell, large quantities of electricity are consumed to produce alkali metal hydroxides, halogens, hydrogen, and alkali metal halates in electrochemical processes familiar to those skilled in the art. With increased cost of energy and fuel, the savings of electricity, even in relatively minor amounts, is of great economic advantage to the commercial operator of the cell. Therefore, the ability to affect savings in electricity through cell operation, cell design, or improvement in components, such as anodes and cathodes, is of increasing significance.

In such electrolytic processes, hydrogen is evolved at the cathode, and the overall reaction may be theoretically represented as:

$$2H_2O+2e^- \rightarrow H_2+2OH^- \quad (1)$$

However, the cathode reaction actually produces monoatomic hydrogen on the cathode surface, and consecutive stages of reaction (1) can be represented as follows:

$$H_2O+e^- \rightarrow H+OH^-$$

$$2H \rightarrow H_2 \quad (2)$$

or as:

$$H_2O+e^- \rightarrow H+OH^-$$

$$H+H_2O+e^- \rightarrow H_2+OH^-$$

The monatomic hydrogen generated as shown in reactions (2) or (3) is adsorbed on the surface of the cathode and desorbed as hydrogen gas.

The voltage or potential that is required in the operation of an electrolytic cell includes the total of the decomposition voltage of the compound being electrolyzed, the voltage required to overcome the resistance of the electrolyte, and the voltage required to overcome the resistance of the electrical connections within the cell. In addition, a potential, known as "overvoltage", is also required. The cathode overvoltage is the difference between the thermodynamic potential of the hydrogen electrode (at equilibrium) and the potential of an electrode on which hydrogen is evolved due to an impressed electric current. The cathode overvoltage is related to such factors as the mechanism of hydrogen evolution and desorption, the current density, the temperature and composition of the electrolyte, the cathode material and the surface area of the cathode.

In recent years, increasing attention has been directed toward improving the hydrogen overvoltage characteristics of electrolytic cell cathodes. In addition to having a reduced hydrogen overvoltage, a cathode should also be constructed from materials that are inexpensive, easy to fabricate, mechanically strong, and capable of withstanding the environmental conditions of the electrolytic cell. Iron or steel fulfills many of these requirements, and has been the traditional material used commercially for cathode fabrication in the chlor-alkali industry. When a chlor-alkali cell is by-passed, or in an open circuit condition, the iron or steel cathodes become prone to electrolyte attack and their useful life is thereby significantly decreased.

Steel cathodes generally exhibit a cathode overvoltage in the range of from about 300 to about 500 millivolts under typical cell operating conditions, for example, at a temperature of about 100° C. and a current density of between about 100 and about 200 milliamperes per square centimeter. Efforts to decrease the hydrogen overvoltage of such cathodes have generally focused on improving the catalytic effect of the surface material or providing a larger effective surface area. In practice, these efforts have frequently been frustrated by cathodes or cathode coatings which have been found to be either two expensive or which have only a limited useful life in commercial operation.

Various coatings have been suggested to improve the hydrogen overvoltage characteristics of electroltyic cell cathodes in an economically viable manner. A significant number of the prior art coatings have included nickel, or mixtures, alloys or intermetallic compounds of nickel with various other metals. Frequently, when nickel is employed in admixture with another metal or compound, the second metal or compound can be leached or extracted in a solution of, for example, sodium hydroxide, to provide a high surface area coatings, such as Raney nickel coatings.

Representative coatings of the prior art are disclosed in U.S. Pat. No. 3,291,714, issued Dec. 13, 1966, and U.S. Pat. No. 3,350,294, issued Oct. 31, 1967. These patents disclose inter alia cathode coatings comprising alloys of nickel-molybdenum or nickel-molybdenum-tungsten electroplated on iron or steel substrates. The electro-deposition of nickel-molybdenum alloys utilizing a pyrophosphate bath is also discussed by Havey, Krohn, and Hanneken in "The Electrodeposition of Nickel-Molybdenum Alloys", *Journal of the Electrochemical Society,* Vol. 110, page 362, (1963).

Other attempts have been made in the prior art to produce coatings of this general variety which offer an acceptable compromise between coating life and low overvoltage characteristics. U.S. Pat. No. 4,105,532, issued Aug. 8, 1978, and U.S. Pat. No. 4,152,240, issued May 1, 1979, are representative of these attempts disclosing, respectively, alloys of nickel-molybdenum-vanadium and nickel-molybdenum using specially selected substrate and intermediate coatings of copper and/or dendritic copper. Similar coatings are also disclosed in U.S. Pat. Nos. 4,033,837 and 3,291,714.

The surface treatment of a Raney nickel electrode with a cadmium nitrate solution for the purpose of reducing hydrogen overvoltage has been investigated by Korovin, Kozlowa and Savel'eva in "Effect of the Treatment of Surface Raney Nickel with Cadmium Nitrate on the Cathodic Evolution of Hydrogen", *Soviet Electrochemistry,* Vol. 14, page 1366 (1978). Although the initial results of such a coating exhibit a good reduction in hydrogen overvoltage, it has been found that the overvoltage increases rapidly to the original level after a short period of operation, i.e. about 2 hours.

Even though many of the coatings described above have been successful in reducing hydrogen overvoltage, they have not proven entirely satisfactory due to rapid deterioration of the coating in caustic environments, ultimately leading to the separation of the coating from the substrate material.

It is thus a primary object of the present invention to provide cathodes suitable for use in electrolytic cells that are economical to prepare, have reduced hydrogen overvoltage characteristics, and exhibit minimal deterioration after prolonged operation in electrolytic environments.

BRIEF DESCRIPTION OF THE INVENTION

In accordance with the present invention, there is provided a cathode for use in electrolytic processes, and a method for producing such cathodes. The present cathode has at least part of its surface portion formed from a codeposit of a first metal selected from the group consisting of iron, cobalt, nickel, and mixtures thereof, a leachable second metal or metal oxide, preferably selected from the group consisting of molybdenum, manganese, titanium, tungsten, vanadium, indium, chromium, zinc, their oxides, and combinations thereof, and a third metal selected from the group consisting of cadmium, mercury, lead, silver, thallium, bismuth, copper, and mixtures thereof. Preferably, this composition is applied as a coating to at least a portion of a substrate material suitably selected from cathode substrates known in the art such as, for example, nickel, titanium, or a ferrous metal, such as iron or steel. The coatings are produced by codepositing, preferably using an electroplating bath or solution, a mixture of the three metals or metal oxides on the substrate surface. If the substrate is other than nickel, the substrate may be coated with a thin intermediate layer of nickel or alloys thereof, prior to depositing the active cathode surface. At least a portion of the second metal or metal oxide is subsequently removed, suitably by leaching using an alkaline solution, such as an aqueous solution of an alkali metal hydroxide. The leaching operation can be performed prior to placing the cathode in operation in an electrolytic cell, or during actual operation in the cell by virtue of the presence of an alkali metal hydroxide in the electrolyte. Optionally, the cathodes of the present invention can be heat treated either before or after at least partial leaching to improve the performance even further. The preferred coating of the present invention comprises a codeposit of nickel, molybdenum, and cadmium.

DETAILED DESCRIPTION OF THE INVENTION

The present cathode comprises at least an active surface portion formed from a codeposit of a first metal selected from the group consisting of iron, cobalt, nickel, and mixtures thereof, a second metal or metal oxide, preferably selected from the group consisting of molybdenum, manganese, titanium, tungsten, vanadium, indium, chromium, zinc their oxides, and combinations thereof, and a third metal selected from the group consisting of cadmium, mercury, lead, silver, thallium, bismuth, copper, and mixtures thereof. The first and third metals are characterized as being substantially nonleachable, i.e. they are removed very slowly, if at all, by leaching or extraction in an alkaline solution. The second metal or metal oxide forming the codeposit is a leachable component, i.e. at least a substantial portion of this component is removable by leaching in an alkaline solution. Hence, the proportions of the metals in the composition can be initially expected to change during operation in the cell, primarily due to the extraction or leaching of the second metal or metal oxide component. The leaching action may be so extensive that virtually all of the second metal or metal oxide is removed from the codeposit. Under such circumstances, the absence of measurable amounts of the second metal does not have an adverse effect on the performance of the cathode. In fact, leaching actually improves the performance of the cathode by increasing the roughness and surface area of the cathode surface. Accordingly, cathodes having measurable quantities of only the first and third metal components in the codeposit after leaching are included within the scope of this invention.

In one embodiment, suitable cathodes can be formed from a codeposit initially containing only the first and third metal components, provided that the surface of the cathode has a roughness factor (defined as the ratio of the measurable surface area to the geometrical surface area) sufficiently high enough to provide the desired decrease in hydrogen overvoltage. An acceptable surface roughness factor in the context of the invention would be at least about 100, and preferably at least about 1,000. Such cathodes can be prepared, for example, using chemical vapor deposition techniques, or by more conventional techniques, such as thermal fusion of the metals and subsequently etching the surface with a strong mineral acid. In this particular embodiment, the composition of the codeposit preferably contains from about 0.5 to about 25 atomic percent, and more preferably from about 1 to about 10 atomic percent, of the third metal component.

In another embodiment, when all three metals or metal oxides are present, the composition of the codeposit contains less than about 40 atomic percent, and preferably more than about 0.5 atomic percent, of the second metal, and from about 0.5 to about 25 atomic percent, preferably 1 to about 10 atomic percent, of the third metal, the balance of the codeposit comprising the first metal component. Surprisingly, it has been found that if the quantity of second metal present in the codeposit does not exceed about 40 atomic percent, the cathode is remarkably stable and exhibits minimal deterioration during sustained operation in electrolytic environments.

In addition to the three metal or metal oxide components, the composition may also include additional elements or compounds due to the particular method utilized for preparing the cathode. Such additional materials may be present in amounts of up to about 50% based on the total weight of the composition, and are perfectly acceptable provided they do not adversely affect the performance of the cathode.

The preferred metals of the present invention are nickel, molybdenum, and cadmium, present in the range of from about 0.5 to about 40 atomic percent of molybdenum, and 0.5 to about 25 atomic percent, and preferably 1 to about 10 atomic percent, of cadium, based on the combined weight of nickel, molybdenum and cadmium, the nickel comprising the balance of the codeposit. Such as cathode has been found to produce surprisingly good results when utilized to electrolyze sodium chloride. For example, hydrogen overvoltages in the range of about 120 millivolts at 150 ma/cm.$^2$ without heat treatment, and 80 millivolts at 150 ma/cm$^2$ after heat treatment, are easily achievable using the cathode surface of this invention when applied to a standard ferrous substrate. These results can be even further improved by the appropriate selection of substrate material and cathode configuration, such as a woven wire mesh, a foraminous sheet, or a perforated and/or expanded metal sheet. Furthermore, simulated life testing of this cathode for a period of 90 days in a 150 gr./liter caustic solution produces a relatively constant cell voltage, indicating suitability for long term operation in a cell.

Although the cathodes of the present invention may be formed entirely from the compositions described hereinabove, it is desirable, both from the standpoint of mechanical durability and reduced costs, to apply the codeposit in the form of a coating to a suitable substrate material. The substrate may be selected from any suitable material having the required electrical and mechanical properties, and the chemical resistance to the particular electrolytic solution in which it is to be used. Generally, conductive metals or alloys are useful, such as ferrous metals (iron or steel), nickel, copper, or valve metals such as tungsten, titanium, tantalum, niobium, vanadium, or alloys of these metals, such as a titanium/-palladium alloy containing 0.2% palladium. Because of their mechanical properties, ease of fabrication, and cost, ferrous metals, such as iron or steel, are commonly used in chlor-alkali cells. However, in chorate cells where corrosion of the substrate material is a significant problem, titanium or titanium alloys are preferred. It may also be desirable to apply an intermediate layer to the substrate material to protect the substrate from corrosion in the electrolytic cell environment. Suitable intermediate layers for this purpose include nickel, nickel codeposited with cadmium, and nickel codeposited with cadmium and bismuth.

The preferred method for applying the surface coating to the substrate material is by electrodeposition in a suitable electroplating solution or bath. Although electrodeposition is a preferred method of preparation primarily due to the favorable economics of this particular procedure, other methods of application, such as vapor deposition, thermal deposition, plasma spraying or flame spraying are also within the scope of this invention.

Prior to coating the substrate in the plating bath, the substrate is preferably cleaned to insure good adhesion of the coating. Techniques for such preparatory cleaning are conventional and well known in the art. For example, vapor degreasing or sand or grit blasting may be utilized, or the substrate may be etched in an acidic solution or cathodically cleaned in a caustic solution. If a substrate material other than nickel is utilized in the present invention, a plating of nickel, suitably electrodeposited, may be initially applied to the portion of the substrate that is to be coated with the cathode surface.

After cleaning, the substrate can then be directly immersed in a plating bath to simultaneously codeposit the three metals or metal oxides. The basic electroplating technique which can be utilized in this invention is known in the prior art. For example, U.S. Pat. No. 4,105,532, issued Aug. 8, 1978, and Havey, Krohn, and Hannekin in "The Electrodeposition of Nickel-Molybdenum Alloys", *Journal of the Electrochemical Society*, Vol. 110, page 362 (1963), describe, respectively, typical sulfate and pyrophosphate plating solutions. By way of illustration, a suitable plating bath for codepositing a coating of nickel, molybdenum and cadmium according to the present invention is described below:

$Na_2MoO_4$: 0.02 M
$NiCl_2$: 0.04 M
$Cd(NO_3)_2$: $3.0\times10^{-4}$ M
$Na_4P_2O_7$: 0.13 M
$NaHCO_3$: 0.89 M
$N_2H_4.H_2SO_4$: 0.025 M
pH: 7.5–9.0
Temperature: 20° C.
Current Density: 0.5 ASI
Plating Time: 30 minutes In general, the pH level of the plating solution is significant in the terms of the efficiency of the plating operation. pH levels in the range of from about 7.5 to about 9.5 are preferred since a pH of less than about 7.5 will tend to produce a coating having a higher hydrogen overvoltage, while a pH of greater than about 9.5 will tend to precipitate nickel hydroxide which, being nonconductive, will also increase the hydrogen overvoltage.

Generally, other sources of nickel, molybdenum, and cadmium may be employed in the plating bath other than those specifically described above. Other soluble salts of the corresponding metals are acceptable. Other complexing agents, such as citrates, other buffering agents and supporting electrolytes, and other reducing agents may also be suitably utilized in substitution for the corresponding ingredients prescribed above.

The actual thickness of the coating will depend, at least in part, on the duration of the electroplating procedure. Coating thicknesses of from about 2 to about 200 microns are acceptable, although thicknesses of from about 10 to about 50 microns are perhaps more useful. Coatings of less than about 10 microns in thickness usually do not have acceptable durability, and coatings of more than 50 microns usually do not produce any additional operating advantages.

Although the concentrations and relative proportions of the various ingredients of the plating bath are not critical, particularly good coatings are produced when the concentration of the cadmium ions in the bath is within the range of from about $1.5\times10^{-4}$ M to about $6.0\times10^{-4}$ M, and when the relative proportion of molybdenum ions to nickel ions in the bath is maintained at about 1:2. Such coatings contain less than about 40 atomic percent of molybdenum prior to leaching. It has also been found that small quantities of a soluble lead salt when added to the plating bath advantageously improve the efficiency of the plating operation.

The codeposit of the active metals or metal oxides may be in the form of a mixture, an alloy, or an intermetallic compound, depending on the particular conditions utilized in preparing the codeposit. Since any of these particular combinations of metals are within the scope of the present invention, the term "codeposit", as used in the present specification and claims, includes any of the various alloys, compounds and inter-metallic phases of the three metals or metal oxides, and does not imply any particular method or process of formulation.

After the coating has been deposited on the substrate material, the second metal component of the coating, e.g. molybdenum, can then be removed. This may be accomplished by immersing the coated cathode in an alkaline solution to leach the molybdenum component. Typically, a 2 to 20% by weight aqueous solution of sodium or potassium hydroxide for a period of about 2–100 hours, suitably at about ambient temperature, can be utilized. If stronger alkaline solutions are employed, or if the alkaline solution is heated, for instance from 50° C. to 70° C., shorter leaching periods are possible. Alternatively, the electroplated cathode can be placed directly into service in an electrolytic cell, with the leaching or extraction being carried out in situ in the cell by the electrolyte during cell operation.

Particularly good coatings have been obtained by heat treating the coating either before, during or after removal of a portion of the molybdenum component. Generally, the heat treatment can be carried out at temperatures of from about 100° C. to about 350° C. for a period of from about ½ hour to about 10 hours. The heat treatment is preferably carried out in an atmosphere is which the coating is inert, for example, argon, nitrogen, helium or neon are applicable suited, although oxygen-containing atmospheres can be used for convenience.

It is particularly advantageous and convenient to heat treat the coated cathode concurrently with a polymer-reinforced diaphragm which has been deposited on the cathode. In fact, it is perfectly acceptable to perform the entire plating operation in a diaphragm cell container using conventional dimensionally stable anodes. Under these conditions, the heat treatment can be accomplished in about one hour at about 275° C.

The cathodes of the present invention have applications in many types of electrolytic cells and can function effectively in various electrolytes. Cathodes having an assortment of configurations and designs can be easily coated using the electroplating technique of this invention, as will be understood by those skilled in the art.

The following examples further illustrate and describe the various aspects of the invention, but are not intended to limit it. Various modifications can be made in the invention without departing from the spirit and scope thereof, as will be readily appreciated by those skilled in the art. Such modifications and variations are considered to be within the purview and scope of the appended claims.

Unless otherwise specified, temperatures in the following examples are in degrees centrigrade, and all parts and percentages are by weight. Hydrogen overvoltages were measured using a reversible hydrogen reference electrode.

EXAMPLE 1

Two nickel plates were cleaned and immersed respectively in two 267 milliliter Hull cells. The first Hull cell contained an aqueous bath of 0.02 M $Na_2MoO_4$; 0.04 M $NiCl_2$; 0.13 M $Na_7P_2O_7$; 0.89 M $NaHCO_3$; and 0.025 M $N_2H_4.H_2SO_4$. The second Hull cell contained the same bath but also included $3.0\times10^{-4}$ M $Cd(NO_3)_2$. Both Hull cells were connected in series, and the plating was carried out at 20° C. at a total current of 4A for 30 minutes. Two 2×2 cm. plated electrodes were cut out of each of the nickel plates, and were leached in 20% NaOH for 15 hours at 70° C. The electrodes were tested as hydrogen cathodes in a solution of 150 g./l NaOH and 170 g./l. NaCl at 95° C. and a current density of 300 ma/cm$^2$. A hydrogen overvoltage of 184 mv. was recorded for the control electrode plated in the first Hull cell without cadmium, and a hydrogen overvoltage of 144 mv. was recorded for the electrode plated in the Hull cell containing cadmium.

EXAMPLE 2

The procedure of Example 1 was repeated to codeposit nickel, molybdenum and cadmium on a nickel expanded mesh screen (50% open) at an average impressed current of 0.65 ASI for 30 minutes. The electrode was subsequently leached in 20% NaOH at 70° C. for 15 hours, and heat treated at 275° C. for 1 hour. The electrode was tested as a hydrogen cathode following the procedure of Example 1, and a hydrogen overvoltage of 87 mv. was recorded.

EXAMPLE 3

The procedure of Example 2 was repeated except that the cadmium content of the bath was reduced to $1.5\times10^{-4}$ M. The electrode was again tested as a hydrogen cathode following the procedure of Example 2, and a hydrogen overvoltage of 108 mv. was recorded.

A comparison of the results illustrated in Examples 1-3 demonstrates the improvement in hydrogen overvoltage obtained by the cathodes of the present invention as compared to the control cathode of the prior art. In particular, Example 1 demonstrates that a 40 millivolt reduction in hydrogen overvoltage is achieved by the cathodes of the present invention. Further improvements obtained by heat treating the cathodes are demonstrated in Examples 2 and 3 for varying concentrations of cadmium in the plating bath.

What is claimed is:

1. A cathode for use in electrochemical processes, at least part of the surface portion of said cathode comprising a codeposit of a first metal selected from the group consisting of iron, cobalt, nickel, and mixtures thereof, a leachable second metal or metal oxide selected from the group consisting of molybdenum, manganese, titanium, tungsten, vanadium, indium, chromium, their oxides and combinations thereof, and from about 0.5 to about 25 atomic percent of a substantially nonleachable third metal selected from the group consisting of cadmium, mercury, lead, thallium, bismuth, and mixtures thereof.

2. The cathode of claim 1 wherein the codeposit is applied as a coating to at least a portion of a substrate material.

3. The cathode of claim 2 wherein substrate is a ferrous metal or an alloy thereof.

4. The cathode of claim 3 wherein the ferrous metal is steel.

5. The cathode of claim 2 wherein the substrate is titanium or an alloy thereof.

6. The cathode of claim 2 wherein the substrate is nickel or an alloy thereof.

7. The cathode of claim 2 which is provided with an intermediate protective layer between the substrate and the coating.

8. The cathode of claim 7 wherein the intermediate protective layer comprises nickel.

9. In an electrolytic cell comprising an anode, a cathode, and an electrolyte, the improvement which comprises providing, as a cathode, the cathode of claim 2.

10. An activated cathode for use in electrolytic processes, at least part of the surface portion of said cathode comprising a codeposit of a first metal selected from the group consisting of iron, cobalt, nickel, and mixtures thereof, and a substantially nonleachable second metal selected from the group consisting of cadmium, mercury, lead, silver, thallium, bismuth, copper, and mixtures thereof, said second metal being present in the range of from about 1 to about 10 atomic percent, the outer surface of said cathode characterized as having a roughness factor of at least about 100.

11. The cathode of claim 10 wherein the codeposit is applied as a coating to at least a portion of a substrate material.

12. The cathode of claim 10 wherein the first metal is nickel and the second metal is cadmium.

13. The cathode of claim 10 wherein the roughness factor is at least about 1000.

14. A cathode for use in electrolytic processes, at least part of the surface portion of said cathode comprising a codeposit of nickel, molybdenum or molybdenum oxide, and cadmium, said cadmium being substantially nonleachable and being present in the range of from about 0.5 to about 25 atomic percent.

15. The cathode of claim 14 wherein the thickness of the coating is from about 10 to about 50 microns.

16. The cathode of claim 14 wherein the molybdenum is present in the range of from about 0.5 to about 40 atomic percent, and the cadmium is present in the range of from about 1 to about 10 atomic percent, based on the three metals in the coating.

17. An activated cathode for use in electrolytic processes, at least part of the surface of said cathode comprising a codeposit of nickel and cadmium, the cadmium being substantially nonleachable and being present in the range of from about 1 to about 10 atomic percent, the outer surface of said cathode characterized as having a roughness factor of at least about 100.

* * * * *